US005413457A

United States Patent [19]

Tuckey

[11] Patent Number: 5,413,457

[45] Date of Patent: May 9, 1995

[54] TWO STAGE LATERAL CHANNEL-REGENERATIVE TURBINE PUMP WITH VAPOR RELEASE

[75] Inventor: Charles H. Tuckey, Cass City, Mich.

[73] Assignee: Walbro Corporation, Cass City, Mich.

[21] Appl. No.: 275,148

[22] Filed: Jul. 14, 1994

[51] Int. Cl.[6] ..... F01D 1/12

[52] U.S. Cl. ..... 415/55.6; 415/84; 415/169.1; 417/251

[58] Field of Search ..... 417/251; 415/55.1, 55.5, 415/55.6, 83, 84, 169.1

[56] References Cited

U.S. PATENT DOCUMENTS

| | | | |
|---|---|---|---|
| 4,408,952 | 10/1983 | Schweinfurter | 415/53 |
| 4,450,354 | 9/1985 | Tuckey | 418/15 |
| 4,556,363 | 12/1985 | Watanabe et al. | 415/53 |
| 4,844,621 | 4/1989 | Aichi et al. . | |
| 4,865,521 | 9/1989 | Ise et al. . | |
| 5,129,796 | 7/1992 | Emmert et al. | 415/55.6 |
| 5,149,252 | 9/1992 | Tuckey | 417/205 |
| 5,257,916 | 11/1993 | Tuckey | 417/423 |
| 5,265,644 | 11/1993 | Tuckey | 137/520 |
| 5,265,997 | 11/1993 | Tuckey | 415/55.1 |
| 5,338,151 | 8/1994 | Kemmner et al. | 415/55.1 |

FOREIGN PATENT DOCUMENTS 2134598 12/1984 United Kingdom .

*Primary Examiner*—Richard A. Bertsch
*Assistant Examiner*—William Wicker
*Attorney, Agent, or Firm*—Barnes, Kisselle, Raisch, Choate, Whittemore & Hulbert

[57] ABSTRACT

A fuel pump structure which includes an electrically driven rotor in a sealed housing which has an inlet and an outlet. A single rotor in the housing has three operating areas. At the outer periphery are vanes operating in an annular sweep channel as a second stage, high pressure regenerative pump which discharges to the housing outlet. Radially within the outer periphery are two radially spaced series of blades forming axial passages in the rotor. The first and outer series of blades operate under a lateral channel to form a first or primary stage pump delivering to a central swirl chamber above and below the rotor. The second and inner series of blades and axial passages allow passage through the rotor to the lower swirl chamber which has a tangential outlet directed to the inlet of the regenerative second stage pump. The base of the lower swirl chamber has a central vapor outlet to allow vapor to leave the fuel which is entering the high pressure pump.

6 Claims, 3 Drawing Sheets

TWO STAGE LATERAL CHANNEL-REGENERATIVE TURBINE PUMP WITH VAPOR RELEASE

FIELD OF THE INVENTION

Vehicle fuel pumps for internal combustion engines using a first stage lateral side channel pump to supply a high pressure turbine regenerative pump.

BACKGROUND OF THE INVENTION

Lateral side channel fuel pumps are know, as illustrated in U.S. patent to Scheinfurther No. 4,408,952 issued Oct. 11, 1983. Regenerative turbine type fuel pumps are known as illustrated in U.S. Pat. No. 4,556,363 to Watanabe et al, issued Dec. 3, 1985. Two stage fuel pumps combining a lateral side channel pump as a first stage and a regenerative turbine pump as a second stage are known, as illustrated in British Patent GB 2,134,598 published Aug. 15, 1984 and in a U.S. Pat. No. 4,408,952 to Schweinfurter.

A pump with a lateral side channel as a first stage and a positive displacement gear rotor as a second stage is disclosed in U.S. Pat. No. 5,149,252 issued Sep. 22, 1992 by Charles H. Tuckey and assigned to the assignee of the present application.

Two stage pumps utilizing a single rotor are illustrated in the above referenced British Patent 2,134,598 and U.S. Pat. 4,408,952, and the concept of vapor release, sometimes referred to as de-gassing is disclosed also in these patents as well as in U.S. Pat. No. 4,149,252.

Thus, two stage fuel pumps utilizing a single rotor, combining a lateral side channel pump and a regenerative turbine pump, and also incorporating vapor release, are illustrated in the above referenced patents. The present invention is directed to a two stage pump with a lateral side channel and a regenerative turbine with a single rotor and a housing which is designed to effectively increase vapor separation and release as well as the efficiency of the combined pumping stages.

SUMMARY OF THE INVENTION

The pump has a rotor operating in a sealed housing with an inlet at one end and an outlet at the other end. The rotor has three operating areas. At the outer periphery, there are vanes operating in an annular sweep channel as a second stage regenerative pump which produces the desired high pressure and directs liquid fuel to the pump chamber and outlet. Radially within the periphery are two radially spaced series of blades forming axial passages in said rotor, the first and outer series of blades operate under an annular lateral channel passage to form a first stage fuel pump delivering fuel to a central swirl chamber above and below the rotor. The second and inner series of blades and axial passages allow fuel to pass through the rotor to said lower swirl chamber. The lower swirl chamber has a central bottom outlet for vapor and a tangential fuel outlet directed to the inlet of the second stage high pressure pump.

Objects, features and advantages of the present invention are to provide a two stage pump with a unique single rotor which serves as a lateral first stage, and a turbine regenerative second stage and also operates in opposed central recesses to control vapor flow as well as feed liquid fuel to the second stage pump, substantially improved vapor separation, increased efficiency, and is of economical manufacture and assembly and has a long useful life in service.

BRIEF DESCRIPTION OF THE DRAWINGS

These and other objects, features and advantages of this invention will be apparent from the following detailed description of the preferred embodiment (s) and best mode, appended claims, and accompanying drawings in which:

DETAILED DESCRIPTION OF THE INVENTION

Figure 1:
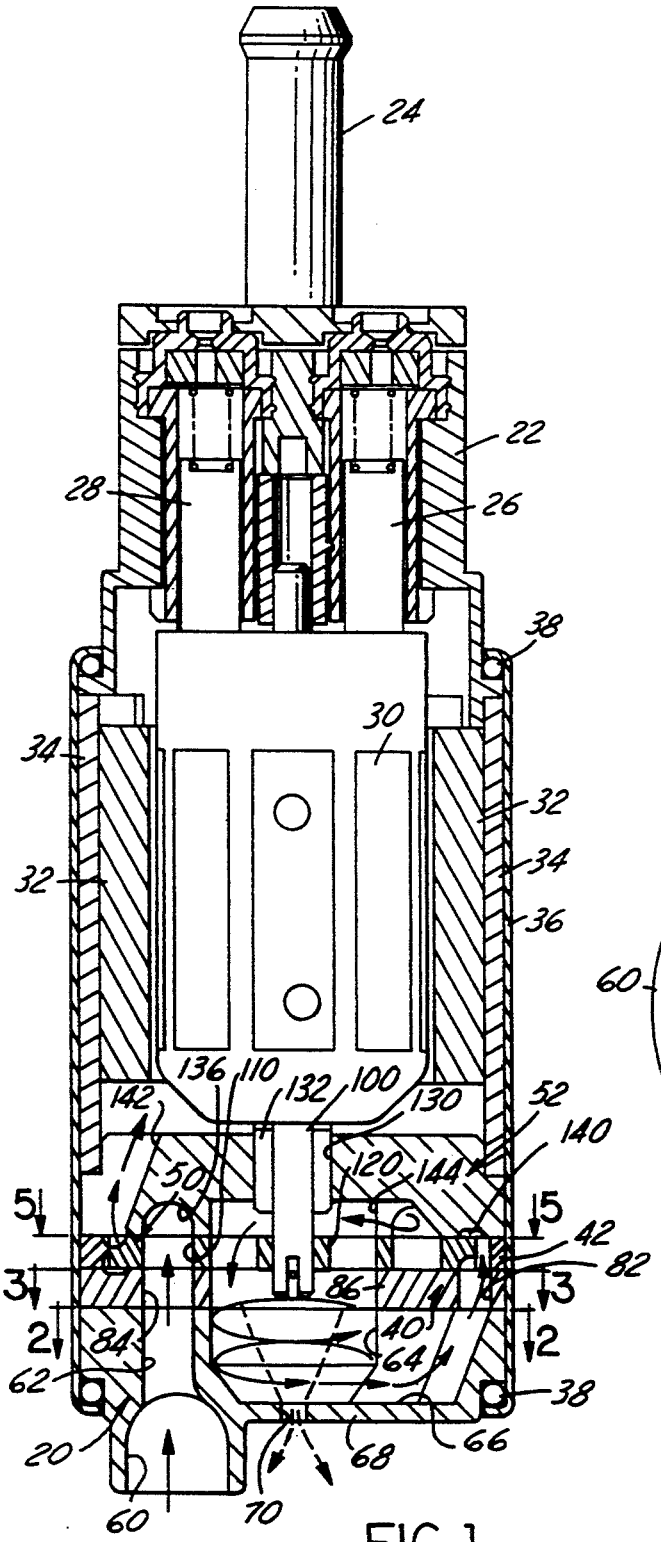
FIG. 1 is a full sectional view of a vehicle fuel pump embodying this invention.

With reference to the drawings, FIG. 1 is a full section of a fuel pump embodying this invention with some of the passages of the components rotated into the plane of the section for purposes of illustration. The actual component parts shown in FIGS. 2 to 13 vary somewhat from the sectional view in FIG. 1. An inlet housing 20 is positioned at one end and an outlet housing 22 is located at the other end of the pump. The outlet housing has a fuel outlet pipe 24 and carries brushes 26, 28 provided for the rotating armature 30 which is surrounded by permanent magnets 32 and a flux ring 34 of an electric drive motor. The operating parts are encased in a metallic shell 36 spun around O-rings 38 at each end. A pump of this general nature is illustrated and described in U.S. Pat. No. 4,540,354 issued Sep. 10, 1985 to Charles H. Tuckey and assigned to the assignee of the present application.

With particular reference to the present invention, the basic parts of the pump include the inlet housing 20, a lower face plate 40, a rotor ring 42, a rotor 50, and an upper face plate 52. The inlet housing 20 forms a base plate for the pump and has a fuel inlet opening 60 ensmalling to a vertical passage 62. Centrally of the housing 20 is a vapor separation chamber 64 (FIG. 2) which has a tangential outlet 66. The chamber 64 tapers to a bottom wall 68 which has a vapor outlet 70. An orientation notch 72 is provided to assist in circumferential alignment of the parts in assembly.

Figure 2:
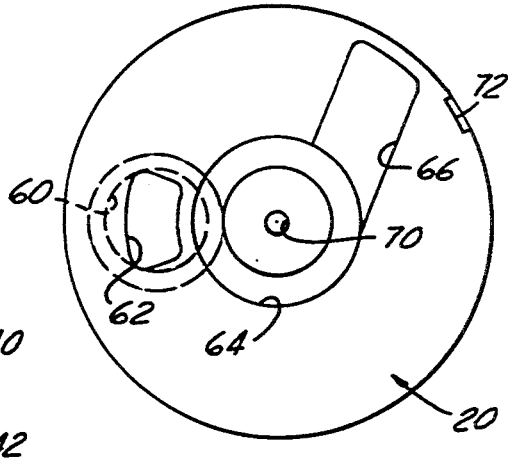
FIG. 2 is a plan view of a base part of the pump below the operating rotor taken on line 2—2 of FIG. 1.
Figure 3:
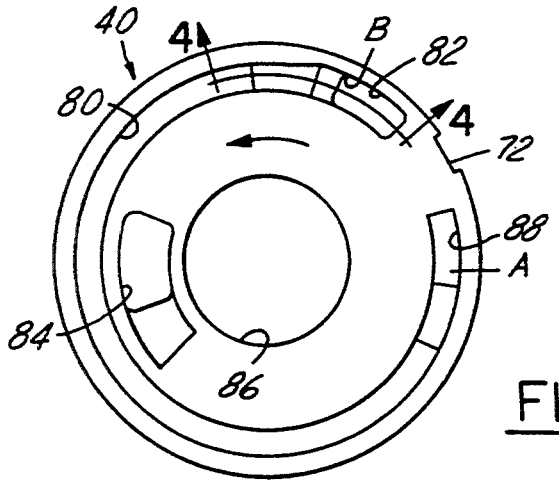
FIG. 3 is a plan view of a face plate below the operating rotor and taken on line 3—3 of FIG. 1.
Figure 4:
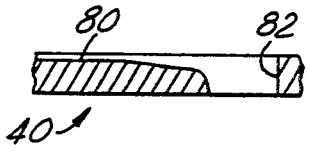
FIG. 4 is a partial sectional taken on line 4—4 of FIG. 3.

Above the inlet housing 20 is the lower face plate 40 shown in a plan view in FIG. 3. This face plate lies below the rotor 50 and has an annular pumping sweep channel 80 originating at a through passage 82 which aligns with the tangential passage 66 of the inlet housing 20. A passage 84 of FIG. 3 aligns with the fuel inlet passage 62 of FIG. 2 . It will be seen that when the lower face plate 40 of FIG. 3 is over laid on the housing 20 of FIG. 2, the passage 82 is aligned with passage 66 of FIG. 2. Centrally of the plate 40 is a circular opening 86 which registers with the chamber 64 of the inlet housing 20. An opening 88, shown in FIG. 3, is the termination of the annular pumping sweep channel 80 and forms an inlet port for the second and high pressure stage pump. Rotation of the rotor 50 is counter clockwise as viewed in FIG. 3.

Figure 5:
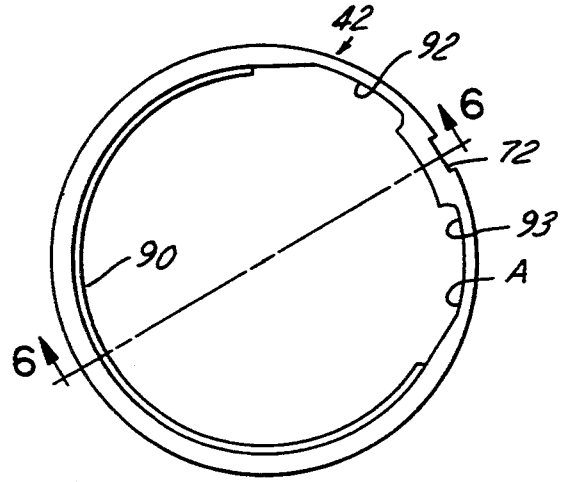
FIG. 5 is a plan view of the stationary outer ring surrounding the rotor taken on line 5—5 of FIG. 1.
Figure 6:
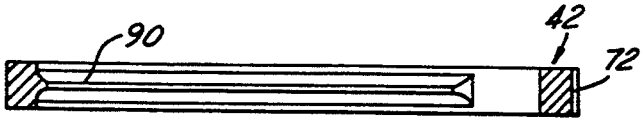
FIG. 6 is a section of the ring illustrated in FIG. 5 taken on line 6—6 of FIG. 5.

Above the lower face plate 40 is the rotor ring 42 which is shown in plan view in FIG. 5 and in section in FIG. 6. This ring has an annular inner rib 90 which tapers toward each side of the ring and extends about 240° around the ring. A notch 92 registers with the inlet port 82 (FIG. 3) of the high pressure pump and a notch 93 registers with the outlet port 88 (FIG. 3). When ring 42 is overlaid on the lower face plate 40 (FIG. 3), the notch 92 will register with the port 82 and the notch 93 will register with port 88.

Figure 7:
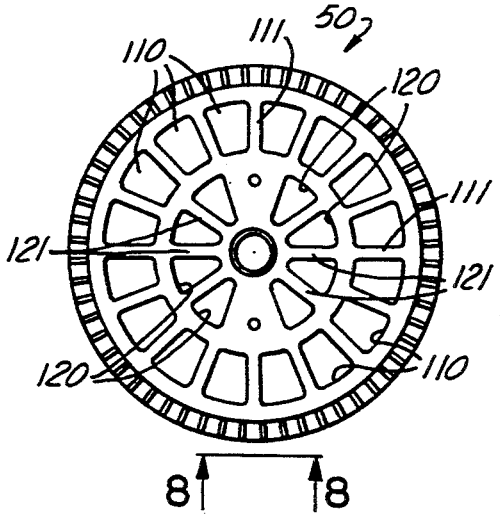
FIG. 7 is a plan view of the pump rotor.
Figure 8:
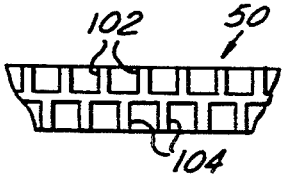
FIG. 8 is a fragmental side view of the edge of the rotor taken on line 8—8 of FIG. 7.
Figure 9:
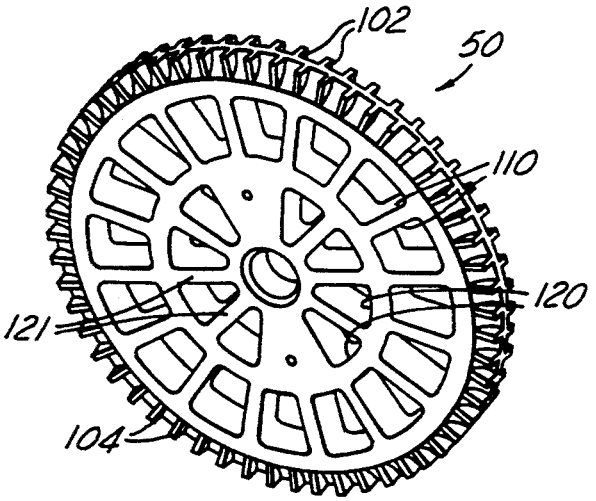
FIG. 9 is a perspective view of the rotor illustrated in FIG. 7.
Figure 10:
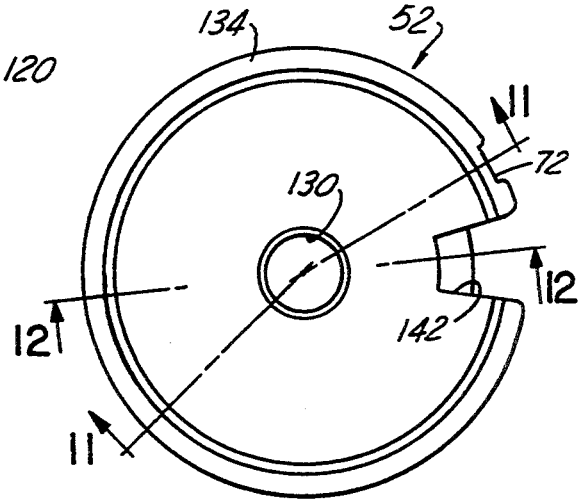
FIG. 10 is a top view of an upper face plate located above the operating pump rotor.

Above the face plate 40, and cooperating with the rotor ring 42, is the pump rotor 50 shown in plan view in FIG. 7, in partial side view in FIG. 8 and in perspective in FIG. 9. This rotor 50 is driven by the armature shaft 100 passing through a center hole in the rotor. The rotor has staggered blades forming pockets 102 on one side and pockets 104 on the other side to form a regenerative turbine type pump of the same type as shown and described in U.S. Pat. Nos. 5,257,916 (Nov. 2, 1993) and 5,265,997 (Nov. 30, 1993) issued to Charles H. Tuckey and assigned to the assignee of the present application.

The rotor 50, however, is distinguished from previous rotors in having two radially spaced series of axial openings inside the toothed periphery. The first series of sixteen spaced trapezoidal openings 110 with intervening blades 111 are located within the periphery. As shown in FIG. 1, these openings 110 register with the inlet passage 62 and 84. The second series of six essentially triangular openings 120 and intervening blades 121 are around the central drive shaft 100. These openings 120 overlie the central opening 86 in the lower face plate 40.

Figure 11:
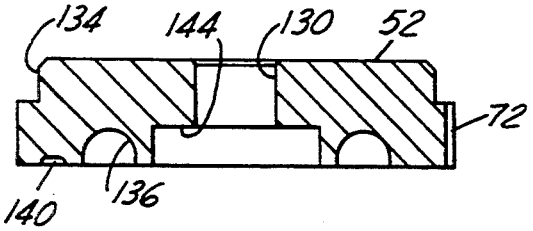
FIG. 11 is a sectional view taken on line 11—11 of FIG. 10.
Figure 12:
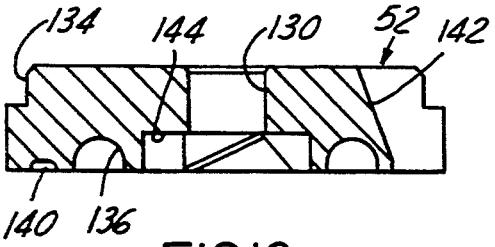
FIG. 12 is a sectional view taken on line 12—12 of FIG. 10.
Figure 13:
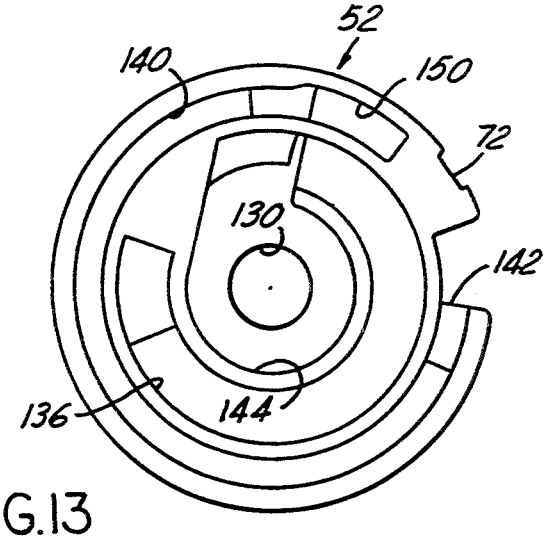
FIG. 13 is a mirror image of the bottom of the upper face plate illustrated in FIGS. 10, 11 and 12 oriented to conform to the orientation of FIGS. 2, 3, 5 and 10.

The upper face plate 52 is positioned above the rotor 50 and is shown in FIGS. 10–13. The view in FIG. 13 is a mirror immage of the bottom surface of plate 52 which faces the rotor 50 oriented to conform to FIGS. 2, 3 and 10. The face plate 52 has a central opening 130 which houses a bearing 132 for the armature shaft 100. An annular top groove 134 receives the lower end of the flux ring 34. An annular lateral side channel 136 (FIGS. 11–13) is radially positioned above the openings 110 of the rotor 50 (FIG. 1) and accompanying blades 111 between the openings. Also, an annular sweep channel 140 (FIGS. 11–13) is positioned above the regenerative blades 102,104 (FIG. 1) as a part of the high pressure second stage pump channels. In FIG. 12 a high pressure outlet channel 142 opens from the regenerative pump sweep channel 140 to the armature chamber and passes pump outlet fuel to the outlet pipe 24. In the bottom surface of the plate 52 is a control chamber 144 which lies above the rotor openings 120 (FIG. 1) and the blades 121 which separate them, and also is directly above the opening 86 in lower plate 40 and the chamber 64 in the inlet housing 20.

When the upper plate 52 is overlaid on the rotor it will be seen that its register notch 72 matches that of the ring 42, lower plate 40 and housing 20. As shown in FIG. 13, when the bottom of plate 52 is placed on rotor 50 with its notch 72 aligned, the high pressure outlet 142 also registers with the lower plate outlet passage 88 and the notch 93 in ring 42 (FIG. 5). The outlet 142 is shown on the left side in FIG. 1, for convenience in the explanation of the operation, but in the actual upper plate 52, as viewed in FIGS. 10, 12 & 13, the pump outlet 142 is on the right side.

The entry of fuel is at 150 in the upper sweep channel 140 of the regenerative pump (FIG. 13) and the rotation of the rotor is counter clockwise in the channel 140 to the high pressure outlet 142.

IN THE OPERATION

The operation of the two stage pump is described in reference to FIG. 1 although it will be appreciated that the location of the actual components, as above described, vary to a degree from those shown in FIG. 1.

The inlet 60 of the pump will be disposed in liquid fuel in a fuel tank or fuel reservoir with appropriate filters. Upon operation of the electric motor and rotor 50, fuel will be drawn up into the passages 62, 84 through the openings 110 between the blades 111 in the rotor to the lateral channel 136 (FIGS. 11–13) of the first pump stage where it will move circumferentially and enter the chamber 144 in housing 52. The swirling fuel will then pass down through the openings 120 in the rotor to the swirl chambers 86 and 64 and receive further rotary impetus as it passes between the moving blades 121 of the rotor. The chamber 64 narrows at the bottom and opens to the tangential outlet 66 (FIGS. 1 and 2). The heavier liquid fuel which is swirling in chamber 64 will move to the outside of the chamber and to outlet 66, while the lighter vaporized fuel will accumulate at the center. This vaporized fuel can exit through the bottom central port 70 while the liquid fuel passes through the tangential passage 66 up through passage 82 in the lower plate 40 and up to the periphery of the regenerative second stage pump where it will enter at 82 (FIGS. 3 and 4) into the lower sweep channel 80 also shown in FIG. 3 and the corresponding upper sweep channel 140 in the upper plate 52 (FIGS. 11, 12 and 13). The fuel in the secondary high pressure regenerative pump moves through the channels 80 and 140 counter clockwise, gaining in pressure, until it exits at passages 88 & 93 into outlet port 142 shown diagrammatically in FIG. 1 and actually in FIGS. 10, 12 and 13. This high pressure fuel enters the armature chamber of the pump and reaches the pump outlet 24 from which it will be delivered to the vehicle engine.

Thus, the fuel from the pump inlet 60 passes upward through the openings 110 in the rotor in upward travel to chamber 144 and then moves downward from chamber 144 through openings 120 in the rotor to the swirl chamber 86, 64, and tangentially outward to the passage 66 and to the inlet of the sweep channels 80, 140 of the second stage, high pressure pump. Meanwhile, vapor is centrifigally separated from the liquid fuel in the swirl chamber, collects centrally of the chamber 64 and exits through port 70.

What is claimed is:

1. A two-stage fuel pump utilizing a single rotor which comprises:

(a) a base housing having an inlet in communication with an inlet of an annular lateral channel in a first radius, a swirl chamber located centrally of said housing and spaced inwardly from said first radius and within a second radius, a lateral channel outlet in communication with said swirl chamber, and a regenerative sweep channel outside said first radius and within said housing, said swirl chamber having an outlet in communication with said sweep channel, said sweep channel having an outlet for fuel under pressure, and (b) a single rotor in said base housing having a first series of circumferentially spaced blades to operate in said sweep channel, a second series of blades forming axial openings at the first radius to rotate adjacent said lateral channel, and a third series of blades forming axial openings in the area of said swirl chamber to pass fuel from said lateral channel to said swirl chamber.

2. A two stage fuel pump as defined in claim 1 in which the outlet from said swirl chamber comprises a tangential passage terminating at said sweep channel.

3. A two stage fuel pump as defined in claim 1 in which said swirl chamber has a central base opening to allow vapor to escape said base housing.

4. A two stage fuel pump as defined in claim 1 in which said swirl chamber tapers toward the bottom of said base housing and a central opening at the bottom of said swirl chamber is provided to allow vapor to escape said base housing.

5. A two stage fuel pump as defined in claim 1 in which a lateral channel outlet chamber is formed above said rotor in communication with said lateral chamber outlet and positioned above said swirl chamber and above said third series of blades, and the axial openings formed by said third series of blades registering with said swirl chamber.

6. A two stage fuel pump for feeding fuel from a supply tank to an internal combustion engine which comprises:

(a) a fuel pump having a drive armature with a drive shaft and outlet housing associated with a pump outlet, (b) a base assembly including a bottom housing having an inlet passage, a bottom central swirl chamber, and an outlet passage for a primary pump, (c) a top housing on said base assembly with an annular lateral channel formed therein and a top central chamber in communication with said lateral channel, (d) a first and second stage single rotor associated with and to be driven by said drive shaft and interposed between said bottom housing and said top housing, said rotor having a first stage pump comprised of a series of circumferentially disposed axial openings and vanes radially registering with said lateral channel, a second series of circumferentially disposed axial openings and vanes radially registering with said central chamber in said top housing and said bottom swirl chamber in said base assembly, and a series of regenerative pump blades in the periphery of said rotor to form a second stage pump, and (e) said outlet for said primary pump extending from said swirl chamber to an inlet to the regenerative pump in a sweep passage coincident with said peripheral blades.

* * * * *